US006015007A

United States Patent [19]

Hunter et al.

[11] Patent Number: 6,015,007

[45] Date of Patent: Jan. 18, 2000

[54] SAND MOLD SHIFT TESTING METHOD

[75] Inventors: William A. Hunter, Naples, Fla.; William G. Hunter, North Barrington, Ill.

[73] Assignee: Hunter Automated Machinery Corporation, Schaumburg, Ill.

[21] Appl. No.: 09/111,033

[22] Filed: Jul. 7, 1998

[51] Int. Cl.[7] ..... B22C 9/02

[52] U.S. Cl. ..... 164/456; 164/29; 164/151.2

[58] Field of Search ..... 164/4.1, 456, 29, 164/137, 151.2, 182, 239

[56] References Cited

U.S. PATENT DOCUMENTS

| | | | |
|---|---|---|---|
| 2,591,314 | 4/1952 | Stelmach | 164/151.2 X |
| 5,174,355 | 12/1992 | Nelson | 164/4.1 |

FOREIGN PATENT DOCUMENTS

| | | | |
|---|---|---|---|
| 3134663 | 3/1983 | Germany | 164/137 |
| 56-6757 | 1/1981 | Japan | 164/137 |
| 57-168747 | 10/1982 | Japan | 164/137 |
| 61-27146 | 2/1986 | Japan | 164/151.2 |
| 4-220136 | 8/1992 | Japan | 164/137 |

*Primary Examiner*—J. Reed Batten, Jr.
*Attorney, Agent, or Firm*—Leydig, Voit & Mayer, Ltd.

[57] ABSTRACT

Cope and drag molds are formed using a matchplate, in which the matchplate has shift blocks on its upper and lower surfaces. The shift blocks form corresponding cavities in the cope and drag molds. Then, a gauge mechanism is calibrated with a gauge standard. The gauge mechanism generally includes a gauge block, a spring biased arm, and a meter adapted to measure movement of the spring biased arm relative to the meter. The calibrating step is performed by sliding the gauge mechanism into the gauge standard which provides prototypical drag and cope mold surfaces. The gauge mechanism is calibrated by setting the meter to zero when the spring biased arm engages the prototypical cope mold surface. Lastly, the gauge mechanism is inserted into the formed cavities in the actual cope and drag molds such that the gauge block engages the drag mold and the spring biased arm engages the cope mold. The meter measures the amount of movement of the spring biased arm and thus the amount and direction of shift of the cope mold relative to the drag mold.

10 Claims, 5 Drawing Sheets

SAND MOLD SHIFT TESTING METHOD

FIELD OF THE INVENTION

The present invention generally relates to sand molds for forming metal castings, and more particularly relates to mechanisms for accurately forming such sand molds.

BACKGROUND OF THE INVENTION

Metal castings are commonly manufactured through a process referred to as green sand molding. The process entails the steps of compressing sand mixed with a binding agent within a flask and around a matchplate. The matchplate typically includes a plurality of protrusions corresponding to the desired shape of the metal casting to be formed. The matchplate has complementary protrusions on the upper and lower surfaces thereof wherein the upper protrusions extend into a cope flask, and the bottom protrusions extend into a drag flask. Squeeze heads are then positioned above and below the cope and drag flasks to be pressed therein to compress the sand within the flasks and around the patterns protruding from the matchplate.

After the green sand is compressed within the cope and drag flasks around the matchplate, the compressed sand within the cope flask is removed to form the cope mold, while the compressed sand within the drag flask is removed to form the drag mold. The cope mold is then placed on top of the drag mold to form a single sand mold, wherein the internal cavities within the cope and drag molds combine to form the overall cavity having the shape of the desired casting. The cavity can then be filled with molten metal and allowed to cool to result in a metal casting. Prior art systems of this type are well known and disclosed in Hunter U.S. Pat. No. 3,406,738 for "Automatic Matchplate Molding Machine"; Hunter U.S. Pat. No. 3,506,058 for "Method Of Matchplate Molding"; Hunter U.S. Pat. No. 3,520,348 for "Fill Carriages For Automatic Matchplate Molding Machines"; Hunter U.S. Pat. No. 5,156,450 for "Foundry Machine And Method In Foundry Mold Made Thereby"; and Hunter U.S. Pat. No. 5,022,512 for "Automatic Matchplate Molding System", each of which are assigned to the present assignee.

In order to form metal castings having a desired shape, the protrusions on the matchplate must form cavities within the cope and drag molds in exact alignment. Not only must the protrusions be dimensioned to have the exact size and shape of the desired casting, but the formed cope and drag molds must be assembled in exact alignment such that the cavity within the cope mold directly aligns with the cavity formed in the drag mold. Even slight shifts in the cope mold with respect to the drag mold on the order of a few thousandths of an inch will form ridges in the resulting casting. The outer surface of the casting will not be continuous, but will have a ridge or ledge at the midway point of the casting as a result of the mis-alignment of the cope mold with respect to the drag mold.

In prior art systems, relatively few means have been provided to ensure that the cope mold is directly aligned with the drag mold, and correspondingly that the cavities within the cope mold directly align with the cavities within the drag mold. For example, such detection has typically been performed by the operator simply by visually observing the cope mold with respect to the drag mold and detecting a shift. However, given today's increasingly stringent standards, such visual confirmation that the cope mold and drag mold are aligned, does not result in metal castings having the exact dimensions and specifications required.

Other prior art shift detection methods have required the sand mold to be cut or sliced in sections. Not only is this system necessarily limited to the detection abilities of human sight, but also results in an unusable sand mold negatively impacting on cost-effectiveness and productivity.

SUMMARY OF THE INVENTION

It is therefore a primary aim of the present invention to provide a sand mold shift testing system for determining the degree and direction of shift of a cope mold with respect to a drag mold.

It is an objective of the present invention to provide a method of measuring to an acceptable level of certainty, the amount and direction of shift of a cope mold with respect to a drag mold.

It is another objective of the present invention to provide the aforementioned system and method to provide an operator with a means for quickly and accurately determining the amount and direction of shift of a cope mold with respect to a drag mold.

It is still another objective of the present invention to provide a method of detecting shift between a cope mold and a drag mold at any point along the molding process.

In accordance with these aims and objectives, it is a feature of a preferred embodiment of the present invention to provide a sand mold shift testing system adapted to measure the amount and direction of shift between a cope mold and a drag mold. The shift test system in the preferred embodiment comprises a matchplate having shift blocks attached thereto, and a gauge mechanism. The matchplate is adapted to attach to a drag flask for forming the drag mold, with the shift plates protruding from a top and bottom of the matchplate for forming complementary cavities in the cope mold and drag mold. The gauge mechanism includes a spring-biased arm and a meter, the arm being normally outwardly biased away from the meter, with movement of the arm being measured by the meter. The shift testing system further includes a gauge block adapted to support the gauge mechanism wherein the gauge mechanism and gauge block are adapted to be slid into the complementary cavities, with the gauge block engaging the drag mold and the spring-biased arm engaging the cope mold. The meter measures the amount and direction of shift of the cope mold relative to the drag mold based on inward or outward movement of the spring-biased arm.

It is another feature of a preferred embodiment of the present invention to provide a method for measuring the amount and direction of shift of a cope mold relative to a drag mold wherein the cope and drag molds have complementary cavities adapted to align when the cope mold is placed atop the drag mold. The method comprises the steps of forming cope and drag molds using a matchplate, calibrating a gauge mechanism using a gauge standard, a spring-biased arm, and a meter, and inserting the gauge mechanism into the test cavities to measure the amount of shift of the cope mold relative to the drag mold. The forming step is performed using a matchplate having shift blocks attached to upper and lower surfaces thereof with the shift blocks attached to the upper surface of the matchplate forming cavities in the cope mold, and the shift blocks attached in the lower surfaces of the matchplate forming cavities in the drag mold. The calibrating step is performed by sliding the gauge mechanism against a gauge standard such that the spring-biased arm engages an upper set point, and the gauge block engages a lower set point. The meter is set to zero when the gauge and standard fully engage to thereby establish a reference point which the measured sand molds should emulate. The gauge mechanism is slid into the test cavity such that the gauge block engages the drag mold and the spring-biased arm engages the cope mold. The meter measures the amount of movement of the spring-biased arm relative to the reference point, and thus the amount and direction of the shift of the cope mold relative to the drag mold.

It is still another feature of a preferred embodiment of the present invention to provide a gauge mechanism for measuring the amount and direction of shift of a cope mold relative to the drag mold comprising a gauge standard, a gauge block, a mounting bracket, a meter, and a spring-biased arm. The gauge mechanism measures the amount and direction of shift of a cope mold relative to a drag mold forming a sand mold, wherein the cope mold sits atop the drag mold and the sand mold includes at least one shift testing cavity formed in a side of the cope mold and drag mold. The gauge block supports the gauge mechanism as it slidably engages the drag flask, the mounting bracket is adapted to rest on top of the gauge block, the meter is held within the mounting bracket, and a spring-biased arm is attached to the meter such that the spring-biased arm is adapted to slidably engage the cope mold, with movement of the spring-biased arm relative the meter being measured by the meter.

These and other aims, objectives, and features of the invention will become more apparent from the following detailed description when taken in conjunction with the accompanying drawings.

Figure 1:
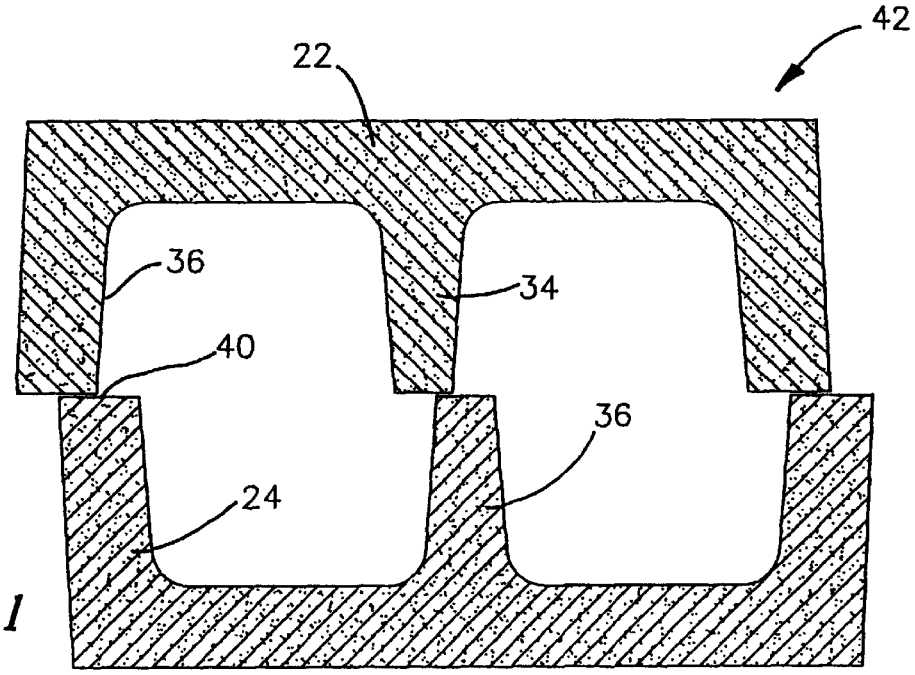
FIG. 1 is a sectional view of a sand mold wherein a shift has occurred between the cope mold and drag mold.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 4:
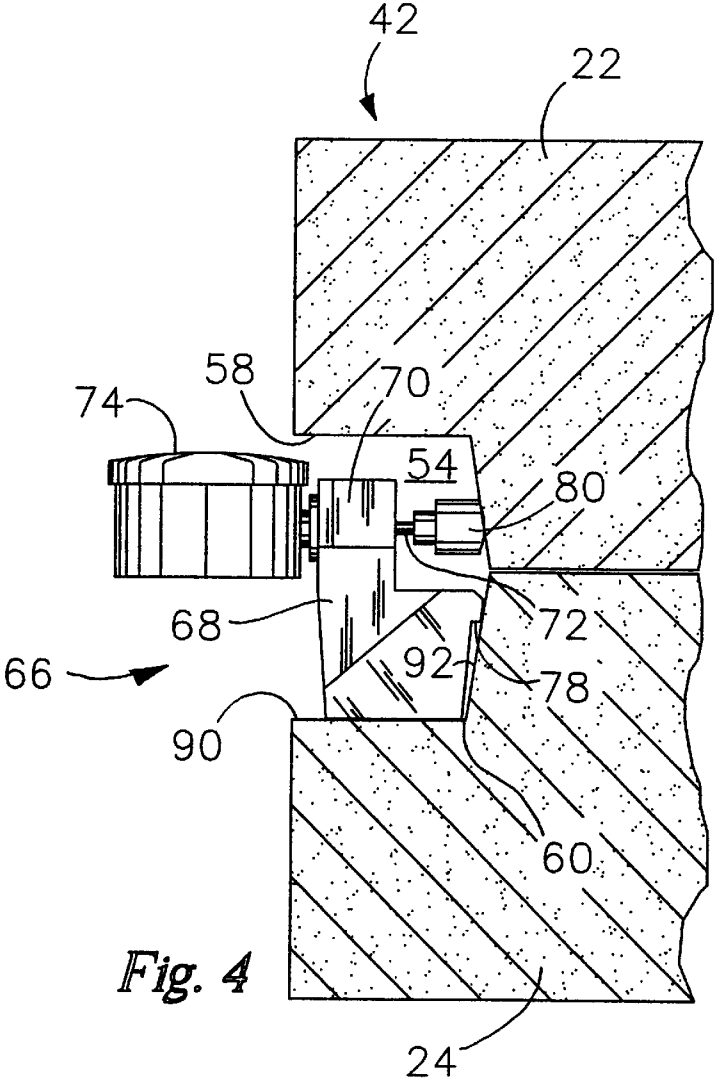
FIG. 4 is a sectional view of a sand mold with the gauge inserted into the shift test cavity and no shift being detected.
Figure 5:
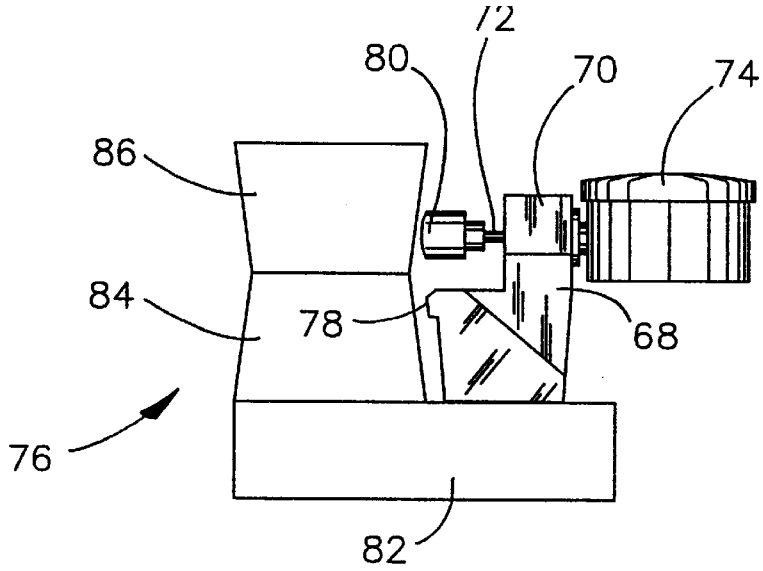
FIG. 5 is a sectional view of a sand mold with the gauge detecting a shift of the cope mold.

Referring now to the drawings, and with particular reference to FIGS. 1, 4 and 5, the preferred embodiment of the present invention is generally referred to as sand mold shift testing system . As shown in FIG. 1, a green sand mold is comprised of an upper half, referred to as cope or cope mold 22, and a lower half referred to as a drag or drag mold 24. Cope mold 22 and drag mold 24 are formed by compressing sand within a rectangular cope flask 26, and a rectangular drag flask 28, respectively (See FIG. 2). A matchplate 30 is provided between cope flask 26 and drag flask 28 and includes a plurality of protrusions or patterns 32. The sand 34 is compressed around patterns 32 to form cavities in the cope mold 22 and drag mold 24 such that when they are assembled together, a cavity 36 having the shape of the desired metal casting is formed. Molten metal can then be poured into the cavity, which when hardened, retains the shape of the desired casting. The sand can then be broken away for harvest of the casting contained therein.

However, as shown in FIG. 1, cope mold 22 can be assembled to drag mold 24 in a mis-aligned state. The shift depicted in FIG. 1 is exaggerated and provided for illustration purposes only, but it should be understood that shifts, even on the order of a few thousandths of an inch, can result in unusable castings. If the cope mold is displaced or shifted from drag mold 24, cavity 36 will necessarily not have the exact shape of the desired casting and can result in a ridge or ledge 40 being formed in the resulting casting. If the shift is sufficiently high, the ledge 40 created can be sufficiently deep such that buffing or grinding cannot result in a usable casting. Even if the ledge 40 is relatively minor, re-working in the form of buffing or grinding will be necessary to result in a usable casting, resulting in additional expense.

It is within the context of these difficulties that the present invention provides a method and apparatus for detecting when a shift has occurred such that the foundry operator can re-adjust the mold forming machine or mold handling equipment to result in substantially aligned sand molds 42 being formed or poured.

Figure 2:
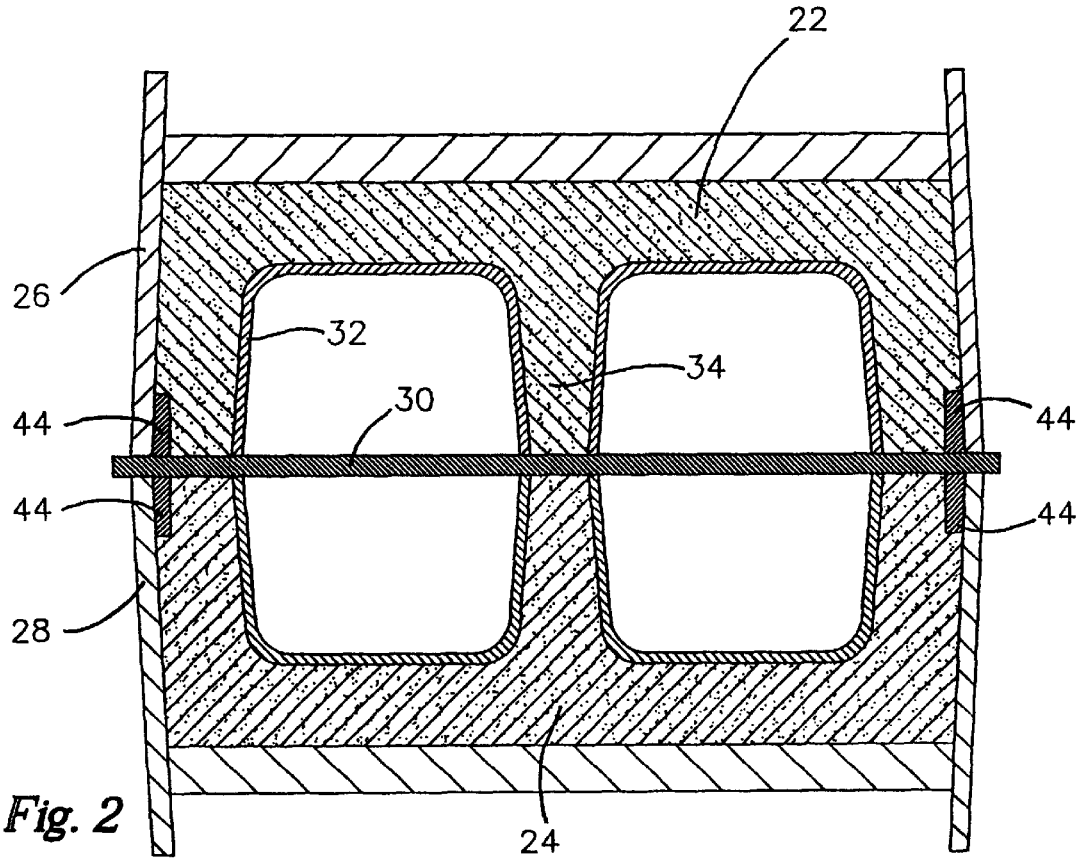
FIG. 2 is a sectional view of a compressed cope flask and drag flask with a matchplate therebetween having the shift test blocks attached to the matchplate.
Figure 3:
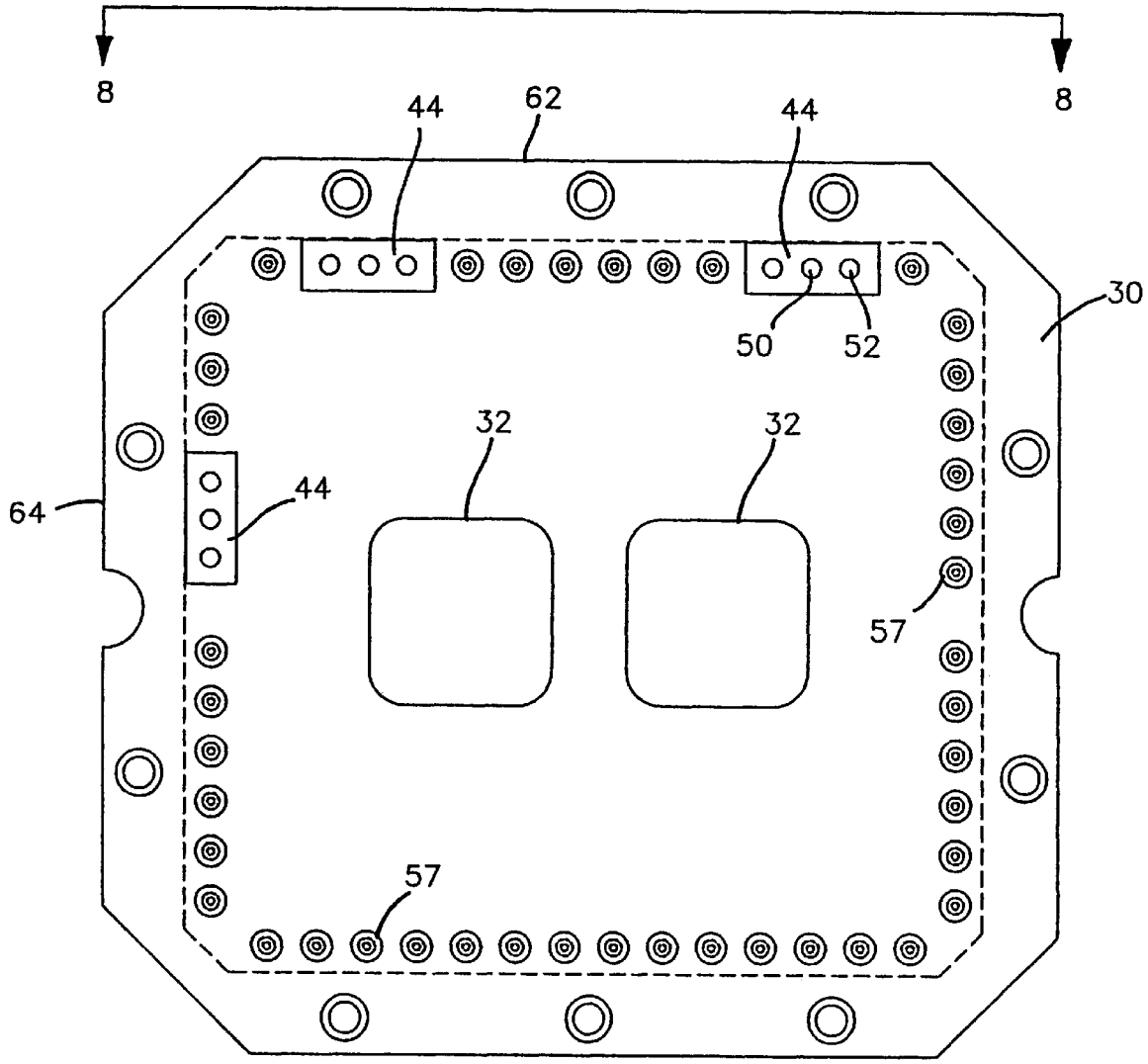
FIG. 3 is a plan view of the matchplate with shift test blocks attached.
Figure 8:
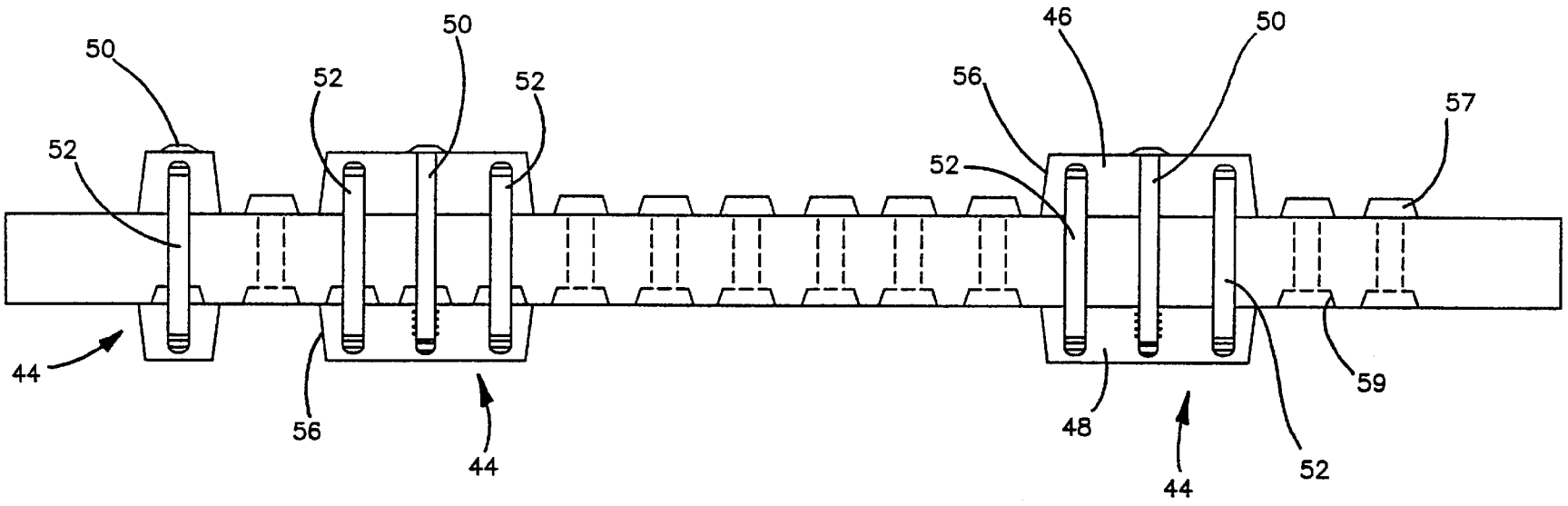
FIG. 8 is a sectional view of a matchplate taken along line 8—8 of FIG. 3 showing the manner in which the shift blocks are attached thereto.

Toward that end, the preferred embodiment of the present invention provides three sets of shift testing blocks 44 which, as best shown in FIGS. 2, 3, and 8, are attached to matchplate 30 about an outer periphery thereof. The three sets of shift blocks 44 actually include an upper block 46 and lower block 48 which are then fastened together using fastener 50 passing through matchplate 30, as well as two alignment pins 52. In alternative embodiments, a different means for securing blocks 44 to matchplate 30 are possible but it is important to ensure that the blocks are correctly aligned so as to avoid physical engagement between the blocks and the cope flask 26 and drag flask 28 during formation of the sand mold 42. Conversely, if the blocks 44 are positioned too far inward, the shift test cavities 54 formed by the blocks 44 can potentially be buried within the sand mold 42 and therefore not allow side access by the operator of the machine. It is also important to note that in the preferred embodiment, the blocks 44 are formed with tapered sides 56 to facilitate insertion and removal of the blocks from sand 34.

Furthermore, matchplate 30 includes a plurality of buttons 57 disposed about its outer periphery on the cope side and aligned with a plurality of complementary recesses 59 on the drag side. Such buttons and recesses form indentations and protrusions in the cope mold and drag mold, respectively, which assist in maintaining proper alignment of the molds, during subsequent handling of the mold.

After sand 34 has been compressed within cope flask 26 and drag flask 28 around matchplate 30 and shift blocks 44, a sand mold 42 will be formed such as that partially shown in FIG. 4. As can be seen therein, shift test cavity 54 is formed by the preferred embodiment wherein cavity 54 is comprised of an upper cavity 58 formed in cope mold 22, as well as a lower cavity 60 formed in drag mold 24. As will be described with further detail herein, three shift test cavities 54 are actually formed, and formed in the relative locations shown in FIG. 3 so as to be able to detect a shift in cope mold 22 in side-to-side, end-to-end, and rotational directions. In other words, two shift test cavities are formed in side 62 of sand mold 42, while a third shift test cavity is formed in side 64 of sand mold 42. Gauge mechanism 66 can be inserted into either shift test cavity in side 62 to detect a shift of cope mold 22 in either side-to-side direction, gauge mechanism 66 can be inserted into shift test cavity 54 in side 64 to detect shift of cope mold 22 in either longitudinal direction, while gauge mechanism 66 can be inserted into both shift test cavities in side 62 to detect rotational shift of cope mold 22.

Figure 6:
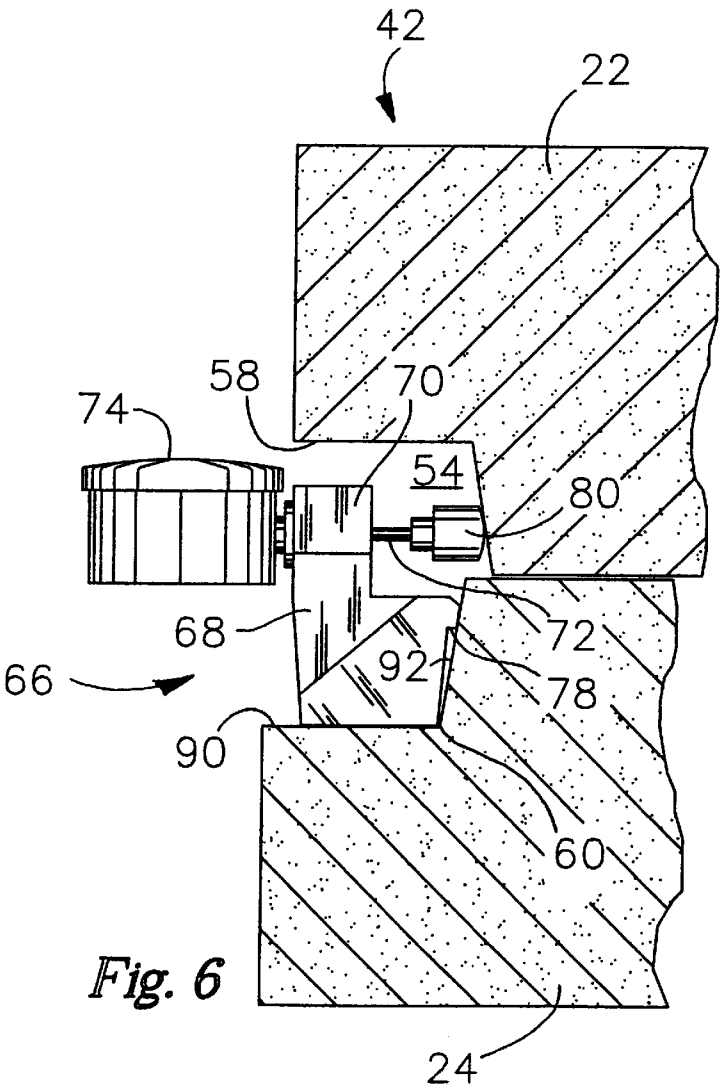
FIG. 6 is a side view of the gauge and gauge standard for calibration purposes.
Figure 7:
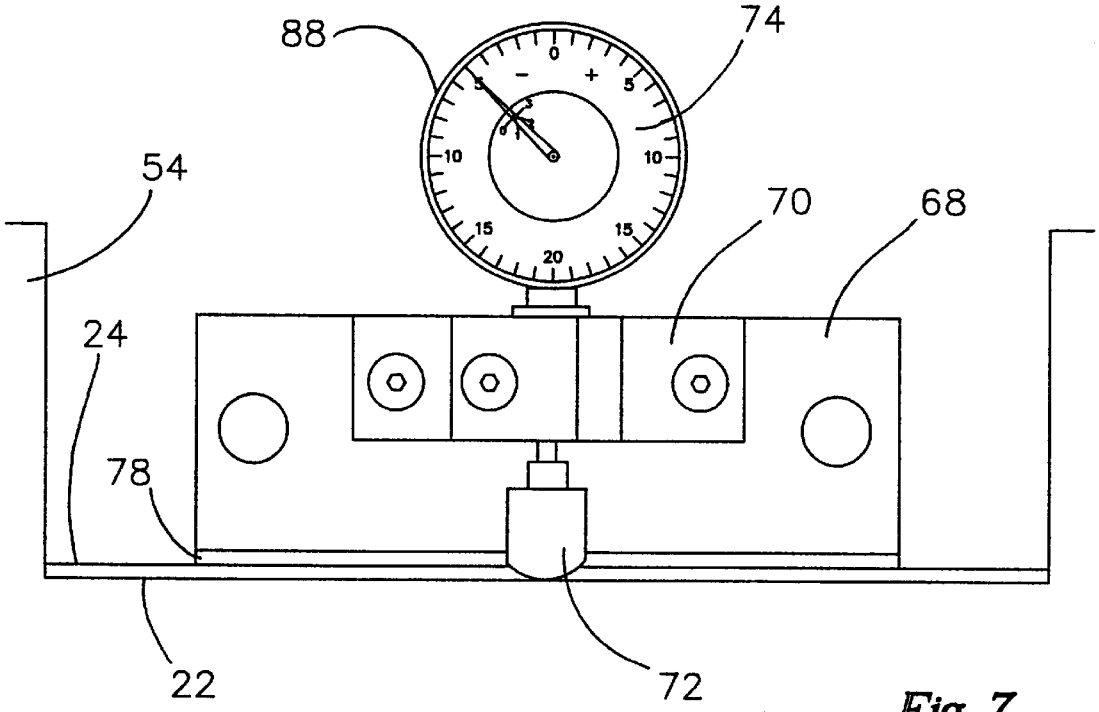
FIG. 7 is a plan view of the gauge dial.

Turning now to the manner in which the shift is actually detected, and the apparatus for detecting such shift, gauge mechanism 66 is shown in FIGS. 5–7. As depicted, gauge mechanism 66 includes gauge block 68, mounting bracket 70, gauge arm 72, gauge meter 74, and gauge standard 76. It is to be understood that gauge meter 74 is adapted to measure the amount of movement of spring-biased arm 72 inwardly and outwardly with respect to meter 74. It is further to be understood that such a meter is commercially available and that the actual design of the meter itself is not the subject of the pending invention, as a variety of measuring apparatus will suffice.

However, the inventive features of the present invention do include the mounting of such a gauge meter and gauge arm on top of a gauge block 68 using mounting brackets 70. As shown in FIG. 5, gauge block 68 includes frontal lip 78 which is adapted, as will be described in further detail herein, to engage drag mold 24. Similarly, gauge arm 72 includes tip 80 which is adapted to engage cope mold 22. By inserting gauge mechanism 66 into shift test cavity 54 until frontal lip 78 of gauge block 68 engages drag mold 24, and tip 80 of gauge arm 72 engages cope mold 22, the relative position of cope mold 22 with respect to drag mold 24 can be detected.

In order to provide meaning to such detection, gauge mechanism 66 must first be calibrated to a set reference point having the relative positions of a perfectly aligned cope mold 22 and drag mold 24. Toward that end, gauge standard 76 is provided as best shown in FIG. 6. As shown therein, gauge standard 76 includes base 82 as well as prototypical drag mold 84 and prototypical cope mold 86. In the preferred embodiment of the present invention, prototypical drag mold 84 and prototypical cope mold 86 are actually formed from shift blocks 44 which are inverted such that their tapered ends converge. The blocks can then be secured to base 82 to form a rigid gauge standard 76. By using shift blocks 44 to form prototypical drag mold 84 and prototypical cope mold 86, not only is the manufacturing cost of the present invention reduced, but the gauge standard 76 will have the exact dimensions of the shift test cavity 54 formed into sand molds 42.

The method for calibrating gauge mechanism 66 begins by placing gauge block 68 squarely on base 82 and sliding the gauge block 68 against gauge standard 76 until frontal lip 78 engages prototypical drag mold 84. This will stop movement of gauge block 68 as well as the insertion of gauge arm 72 into gauge meter 74. Since gauge arm 72 is spring-biased outwardly, tip 80 of gauge arm 72 will always engage prototypical cope mold 86 prior to frontal lip 78 engaging the prototypical drag mold 84.

At this point, gauge meter 74 can be calibrated to zero which will then serve as a reference point when each of the shift test cavities 54 is actually measured. Any deviations of the meter either in a positive or negative direction will indicate to the operator that some sort of shift of the cope mold 22 with respect to the drag mold 24 has occurred. If the meter 74 results in a zero reading, the operator will be thereby told that no shift has occurred. In the preferred embodiment of the present invention such "zeroing", is performed using a rotatable dial 88 provided on the outer circumference of gauge meter 74. Once frontal lip 78 and tip 80 engage prototypical drag mold 84 and prototypical cope mold 86 respectively, dial 88 can be rotated until its graduated bezel corresponds to a reading of zero, (see FIG. 7). When the gauge is removed from gauge standard 76, the meter reading will necessarily increase due to the fact that gauge arm 72 is spring-biased outward. However, once gauge arm 72 is contracted into gauge meter 74 such that tip 80 is in exact vertical alignment with frontal lip 78, meter 74 will again be zero.

Once gauge mechanism 66 is calibrated, it can be inserted into the formed shift test cavities 54 within sand mold 42. The shift can then be detected by sliding gauge block 68 along shelf 90 formed in drag mold 24 until frontal lip 78 engages inside wall 92 of shift test cavity 54. Depending on the relative location of cope mold 22 with respect to drag mold 24, gauge arm 72 will have been contracted into gauge meter 74 to result in a certain meter reading. If the cope mold 22 has shifted away from the meter, the meter reading will necessarily be positive in that the gauge arm 72 is substantially extended away from the calibrated or zero position. Conversely, if the cope mold 22 has shifted toward the gauge meter 74, the meter reading will be of a negative value in that the gauge arm 72 will be contracted into gauge meter 74 beyond the zero or calibrated position. For illustration purposes, FIG. 7 is provided wherein FIG. 7 shows a negative reading.

As stated herein, the preferred embodiment of the present invention provides three shift test cavities 54 so that an operator can detect all possible directions of shift. After such testing has been performed, the operator can then perform operations to correctly align cope mold 22 with drag mold 24, and perhaps more importantly correct the machine forming sand molds 42 such that subsequent sand molds formed will be formed in exact alignment. In addition, testing can occur along the mold handling lines to detect shifts therein and allow for correction.

From the foregoing, it can therefore be seen to one of ordinary skill in the art that the present invention brings to the art a new and improved system for detecting when or where shift has occurred between a cope mold and a drag mold. Once the shift has been detected, and measured to within a few thousandths of an inch, the cope mold can be exactly aligned with the drag mold, and the machine forming the sand mold can be retooled to form correctly aligned cope molds and drag molds. As a result, castings having a perceptible ridge at the point where the cope and drag meet can be avoided and the costs associated with unusable castings, as well as buffing or grinding of improperly formed castings can be avoided. Moreover, through the method of the present invention, such shift testing can be performed at all stages during sand mold creation and handling to allow the foundry operators to detect the exact point where the shift is occurring to thereby pinpoint the part of the molding system which needs to be corrected.

What is claimed is:

1. A method for measuring the amount and direction of shift of a cope mold relative to a drag mold, the cope and drag molds having complementary cavities adapted to align when the cope mold is placed atop the drag mold, the method comprising the steps of;

forming cope and drag molds using a matchplate having shift blocks attached to upper and lower surfaces thereof, the shift blocks attached to the upper surface of the matchplate forming cavities in the cope mold, the shift blocks attached to the lower surface of the matchplate forming cavities in the drag mold;

calibrating a gauge mechanism including a gauge block, a spring-biased arm, and a meter adapted to measure movement of the spring-biased arm relative to the meter, the calibrating step being performed by sliding the gauge block against a gauge standard having prototypical drag and cone mold surfaces such that the spring-biased arm engages the prototypical cope mold surface, the meter being set to zero when the spring-biased arm engages the prototypical cope mold surface to thereby establish a reference point; and inserting the gauge mechanism into the cavities such that the gauge block engages the drag mold and the spring-biased arm engages the cope mold, the meter measuring the amount of movement of the spring-biased arm relative to the reference point, and thus the amount and direction of the shift of the cope mold relative to the drag mold.

2. The method of claim 1 wherein the forming step results in three cavities on outer side surfaces of the sand mold, two of the three cavities being on the same side of the sand mold.

3. The method of claim 1 wherein the calibrating step is performed using a meter having a rotatable outer dial, the meter being set to zero by rotating the outer dial such that the meter has a reading of zero during the calibration step.

4. The method of claim 1 wherein the gauge block includes a lip on a front surface thereof, the block being slid until the lip engages the drag mold.

5. The method of claim 1 wherein during the inserting step, inward movement of the spring-biased arm signifies a shift of the cope mold relative to the drag mold and toward the gauge mechanism.

6. The method of claim 1 wherein during the inserting step, outward movement of the spring-biased arm signifies a shift of the cope mold relative to the drag mold and away from the gauge mechanism.

7. The method of claim 1 further including the step of adjusting the position of the cope mold relative to the drag mold if a shift between the two is detected.

8. A method for measuring the amount and direction of shift of a cope mold relative to a drag mold, the cope and drag molds having complementary cavities adapted to align when the cope mold is placed atop the drag mold to form a sand mold, the method comprising the steps of:

forming cope and drag molds using a matchplate having shift blocks attached to upper and lower surfaces thereof, the shift blocks attached to the upper surface of the matchplate forming gauge cavities in the cope mold, the shift blocks attached to the lower surface of the matchplate forming gauge cavities in the drag mold, the shift blocks being positioned on the matchplate to form complementary gauging cavities in the resulting sand mold, the gauging cavities having at least a guide surface for a gauge and a pair of relatively positioned gauging surfaces indicating the alignment of the cope and drag molds; and inserting a gauge into one of the gauge cavities, the gauge having a gauge guide being guided on the guide surface of the gauge cavity, a first gauging member positioned to contact the gauging surface of the drag mold, a second gauge member adapted to contact the gauging surface of the cope mold, and an indicator indicating the relative position between the gauging surfaces, whereupon guiding the gauge into the gauge cavity along the guide surface until the respective gauging elements contact the associated gauging surfaces indicate the direction and amount of alignment or misalignment between the cope and drag molds at the gauge cavity.

9. The method of claim 8 wherein at least two gauging cavities are formed in the same side of the sand mold, and further including the step of inserting the gauge into the gauge cavities for determination of rotational misalignment.

10. The method of claim 8 wherein gauging cavities are formed in at least two orthogonal sides of the sand mold, and further including the step of inserting the gauge into the gauge cavities for determination of both lateral and longitudinal misalignment.

* * * * *

UNITED STATES PATENT AND TRADEMARK OFFICE

CERTIFICATE OF CORRECTION

PATENT NO. : 6,015,007

DATED : January 18, 2000

INVENTOR(S) : Hunter et al.

It is certified that error appears in the above-identified patent and that said Letters Patent is hereby corrected as shown below:

In claim 1, line 15, change "cone" to "cope".

Signed and Sealed this

Seventeenth Day of October, 2000

*Attest:*

Q. TODD DICKINSON

*Attesting Officer*

*Director of Patents and Trademarks*